US007677425B2

(12) United States Patent
Brendel et al.

(10) Patent No.: US 7,677,425 B2
(45) **Date of Patent: *Mar. 16, 2010**

(54) DEPTH ADJUSTING DEVICE FOR A POWER TOOL

(75) Inventors: Lee Michael Brendel, Bel Air, MD (US); Paul G. Gross, White Marsh, MD (US); James J. Kenny, Baltimore, MD (US); Larry Eugene Gregory, Baltimore, MD (US); John E. Buck, Cockeysville, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/061,431

(22) Filed: Apr. 2, 2008

(65) Prior Publication Data

US 2008/0185417 A1 Aug. 7, 2008

Related U.S. Application Data

(63) Continuation of application No. 11/586,107, filed on Oct. 25, 2006, now Pat. No. 7,427,008.

(51) Int. Cl.
*B25C 1/04* (2006.01)

(52) U.S. Cl. ..... 227/8; 227/129; 227/142

(58) Field of Classification Search ..... 227/8, 227/129, 2, 7, 119, 120, 121, 125, 142, 130
See application file for complete search history.

(56) References Cited

U.S. PATENT DOCUMENTS

| | | | |
|---|---|---|---|
| 2,786,672 | A | 3/1957 | Humphner |
| 3,018,584 | A | 1/1962 | Passariello |
| 3,067,724 | A | 12/1962 | Jenny et al. |
| 3,140,492 | A | 7/1964 | Bade |
| 3,554,428 | A | 1/1971 | Smith |
| 4,042,036 | A | 8/1977 | Smith et al. |
| 4,121,745 | A | 10/1978 | Smith et al. |
| 4,129,240 | A | 12/1978 | Geist |
| 4,298,072 | A | 11/1981 | Baker et al. |

(Continued)

FOREIGN PATENT DOCUMENTS

| | | |
|---|---|---|
| DE | 35 06 421 | 9/1968 |

(Continued)

*Primary Examiner*—Paul R Durand
(74) *Attorney, Agent, or Firm*—Harness, Dickey & Pierce, P.L.C.

(57) ABSTRACT

A fastening tool can include a housing and a motor assembly in the housing. The motor assembly can include an output member and a motor for translating the output member. A knob can be rotatably mounted in the housing around a first axis and define a plurality of locating formations arranged thereon. An adjustment rod can be operatively coupled for movement with the knob. A lower contact trip can be coupled to the adjustment rod. An indexing member can be movable along a second axis parallel to the first axis. The indexing member can be selectively biased into engagement with one of the locating formations upon rotation of the knob to resist rotation of the knob relative to the housing. Rotation of the knob can cause the contact trip to translate toward and away from the housing to define a desired penetration depth for the fastener.

17 Claims, 12 Drawing Sheets

U.S. PATENT DOCUMENTS

| | | | | |
|---|---|---|---|---|
| 4,432,483 | A | 2/1984 | Kuck | |
| 4,721,170 | A | 1/1988 | Rees | |
| 4,767,043 | A | 8/1988 | Canlas, Jr. | |
| D307,234 | S | 4/1990 | Fushiya et al. | |
| 4,928,868 | A | 5/1990 | Kerrigan | |
| D322,204 | S | 12/1991 | Lee | |
| 5,069,379 | A | 12/1991 | Kerrigan | |
| 5,098,004 | A | 3/1992 | Kerrigan | |
| D330,836 | S | 11/1992 | Fushiya et al. | |
| D333,601 | S | 3/1993 | Wingert | |
| 5,199,625 | A | 4/1993 | Dewey et al. | |
| 5,219,110 | A * | 6/1993 | Mukoyama | 227/8 |
| D338,606 | S | 8/1993 | Oda | |
| 5,231,750 | A | 8/1993 | Fealey | |
| D340,630 | S | 10/1993 | Hara | |
| 5,261,587 | A | 11/1993 | Robinson | |
| D350,681 | S | 9/1994 | Juhlin et al. | |
| 5,350,103 | A | 9/1994 | Monacelli | |
| 5,385,286 | A * | 1/1995 | Johnson, Jr. | 227/8 |
| 5,443,196 | A | 8/1995 | Burlington | |
| 5,565,614 | A | 10/1996 | Klauke et al. | |
| D376,523 | S | 12/1996 | Arai | |
| 5,579,977 | A * | 12/1996 | Yang | 227/142 |
| D383,657 | S | 9/1997 | Kaiser | |
| 5,662,257 | A | 9/1997 | Mukoyama et al. | |
| 5,667,127 | A | 9/1997 | Ichikawa et al. | |
| 5,685,473 | A | 11/1997 | Shkolnikov et al. | |
| 5,715,982 | A | 2/1998 | Adachi | |
| 5,839,638 | A | 11/1998 | Ronn | |
| D406,999 | S | 3/1999 | Saver et al. | |
| D410,182 | S | 5/1999 | Etter et al. | |
| 6,012,622 | A | 1/2000 | Weinger et al. | |
| 6,024,267 | A * | 2/2000 | Chen | 227/8 |
| D426,124 | S | 6/2000 | Kassalen et al. | |
| D432,077 | S | 10/2000 | Zurwelle et al. | |
| 6,138,887 | A | 10/2000 | Nayrac et al. | |
| 6,145,724 | A | 11/2000 | Shkolnikov et al. | |
| D435,013 | S | 12/2000 | Clowers et al. | |
| 6,164,510 | A | 12/2000 | Deieso et al. | |
| D435,769 | S | 1/2001 | Etter et al. | |
| 6,170,729 | B1 | 1/2001 | Lin | |
| 6,186,386 | B1 | 2/2001 | Canlas et al. | |
| D440,136 | S | 4/2001 | Buck | |
| 6,209,770 | B1 | 4/2001 | Perra | |
| 6,264,085 | B1 | 7/2001 | Ho et al. | |
| 6,357,534 | B1 | 3/2002 | Buetow et al. | |
| 6,371,348 | B1 | 4/2002 | Canlas et al. | |
| D459,184 | S | 6/2002 | Buck | |
| D461,694 | S | 8/2002 | Buck | |
| D466,863 | S | 12/2002 | Zurwelle et al. | |
| 6,488,195 | B2 | 12/2002 | White et al. | |
| 6,557,745 | B2 * | 5/2003 | Wang | 227/142 |
| D476,151 | S | 6/2003 | Peterson | |
| 6,581,815 | B1 * | 6/2003 | Ho et al. | 227/142 |
| 6,601,748 | B1 * | 8/2003 | Fung et al. | 227/176.1 |
| 6,604,666 | B1 | 8/2003 | Pedicini et al. | |
| 6,609,646 | B2 | 8/2003 | Miller et al. | |
| 6,648,202 | B2 | 11/2003 | Miller et al. | |
| 6,679,413 | B2 | 1/2004 | Miller et al. | |
| 6,705,501 | B2 | 3/2004 | Miller et al. | |
| 6,705,503 | B1 | 3/2004 | Pedicini et al. | |
| 6,763,992 | B2 * | 7/2004 | Hirai | 227/142 |
| 6,766,935 | B2 | 7/2004 | Pedicini et al. | |
| 6,769,593 | B2 | 8/2004 | Pedicini et al. | |
| 6,772,931 | B2 | 8/2004 | Miller et al. | |
| 6,883,696 | B1 | 4/2005 | Steinbrunner et al. | |
| 6,896,801 | B2 | 5/2005 | Anderson et al. | |
| 6,938,812 | B2 | 9/2005 | Miller et al. | |
| 6,948,647 | B1 | 9/2005 | Niblett et al. | |
| 6,971,567 | B1 | 12/2005 | Cannaliato et al. | |
| 6,988,648 | B2 | 1/2006 | Taylor et al. | |
| 6,997,365 | B2 | 2/2006 | Miller et al. | |
| 7,097,084 | B2 | 8/2006 | Ho | |
| 7,213,732 | B2 * | 5/2007 | Schell et al. | 227/8 |
| 7,341,172 | B2 * | 3/2008 | Moore et al. | 227/8 |
| 7,427,008 | B2 * | 9/2008 | Brendel et al. | 227/8 |
| 7,431,187 | B2 * | 10/2008 | Tachihara et al. | 227/142 |
| 2002/0185514 | A1 | 12/2002 | Adams et al. | |
| 2006/0065692 | A1 | 3/2006 | Taylor et al. | |

FOREIGN PATENT DOCUMENTS

| | | |
|---|---|---|
| DE | 1 814 629 | 12/1968 |
| DE | 1 603 942 | 9/1971 |
| DE | 1 603 943 | 3/1972 |
| DE | 25 59 946 | 9/1975 |
| DE | 31 26 536 | 1/1983 |
| EP | 0 336 021 | 10/1989 |
| EP | 0 591 671 | 4/1994 |
| EP | 1 147 860 | 10/2001 |
| EP | 1 258 323 | 11/2002 |

* cited by examiner

DEPTH ADJUSTING DEVICE FOR A POWER TOOL

CROSS-REFERENCE TO RELATED APPLICATIONS

This application is a continuation of U.S. patent application Ser. No. 11/586,107, filed on Oct. 25, 2006 now U.S. Pat. No. 7,427,008. The disclosure of the above application is incorporated herein by reference.

FIELD

The present disclosure relates to power tools, and more particularly to a depth adjusting device for a power tool.

BACKGROUND

Fastening tools, such as nailers and staplers, are relatively commonplace in the construction trades. Many features of typical fastening tools, while adequate for their intended purpose, do not provide the user with a desired degree of flexibility and function. For example, it would be beneficial in some instances to adjust a penetration depth of a fastener. Accordingly, there remains a need in the art for an improved fastening tool.

SUMMARY

A fastening tool can include a housing and a motor assembly in the housing. The motor assembly can include an output member and a motor for translating the output member. A knob can be rotatably mounted in the housing around a first axis and define a plurality of locating formations arranged thereon. An adjustment rod can be operatively coupled for movement with the knob. A lower contact trip can be coupled to the adjustment rod. An indexing member can be movable along a second axis parallel to the first axis. The indexing member can be selectively biased into engagement with one of the locating formations upon rotation of the knob to resist rotation of the knob relative to the housing. Rotation of the knob can cause the contact trip to translate toward and away from the housing to define a desired penetration depth for the fastener.

According to additional features, the fastening tool 10 comprise an adjustment element coupled for rotation with the rod. The adjustment element can comprise a pinion that defines an outer diameter meshed for rotation with the knob and an inner diameter threaded for rotation with the adjustment rod. The pinion can transfer rotational movement of the knob into linear translation of the adjustment rod. The indexing member can impart a retaining force onto the knob, thereby inhibiting rotation of the knob when the indexing member is engaged with one of the locating formations. The indexing member can define a dome-like engagement surface adapted to nest within one of the plurality of locating formations.

According to additional features, the pinion can define pinion teeth formed along a length thereof. Depression of the lower contact trip can cause the pinion to move along a pinion axis and the pinion teeth to slide along, and remain meshed for rotation with, complementary knob teeth formed along the knob without imparting rotation onto the knob.

According to other features, the fastening tool can include a series of indicia arranged around a radial surface of the knob. Each of the series of indicia can correspond to a selected penetration depth. The selected penetration depth can coincide with the indexing member being engaged with one of the locating formations. The knob can define a rib formed thereon. The rib can be adapted to engage structure fixed to the housing and inhibit further rotation of the knob, thereby defining a rotational limit of the knob. In one example, the knob can be at least partially extending through an aperture formed on the housing.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
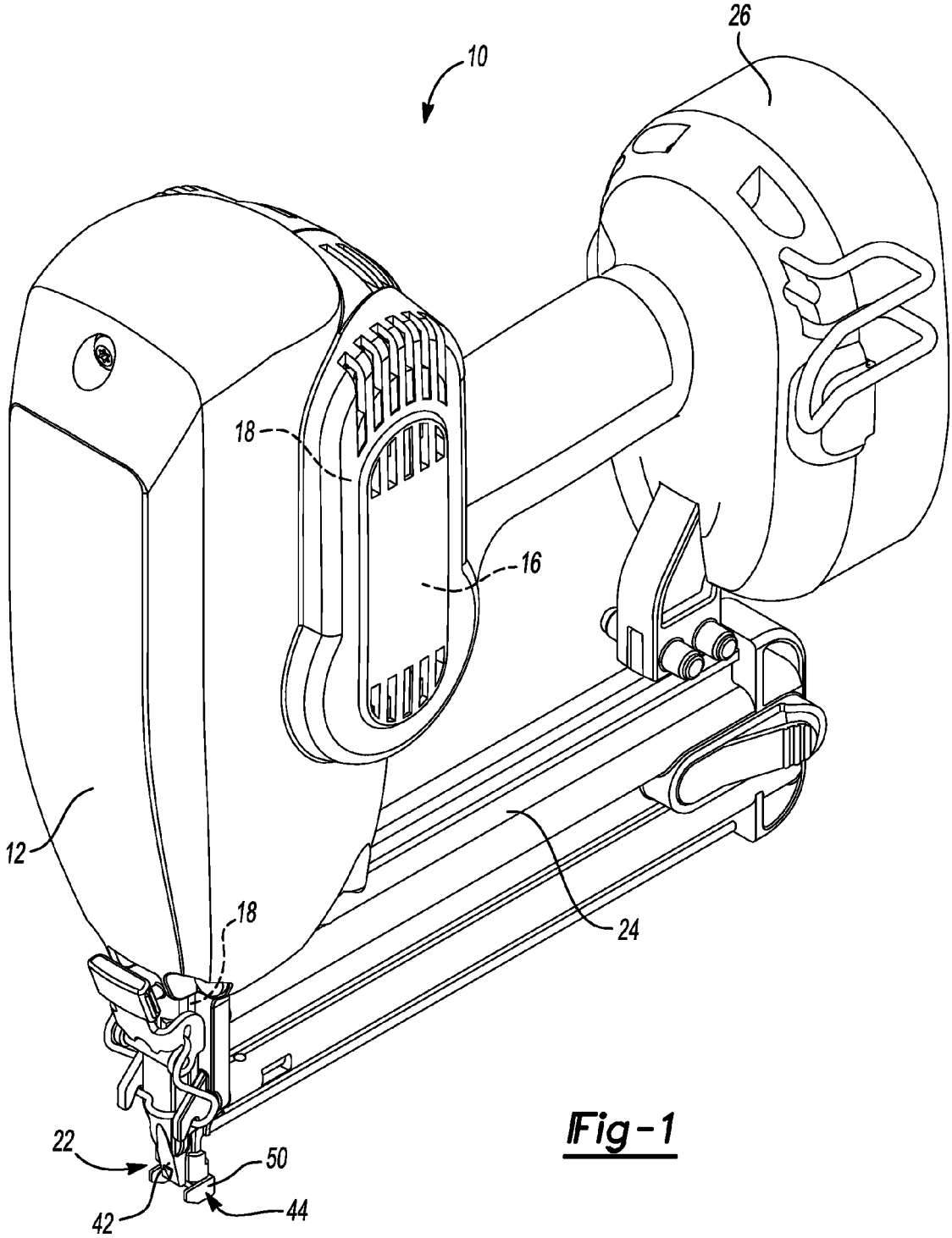
FIG. 1 is a perspective view of an exemplary cordless fastening tool constructed in accordance with the teachings of the present disclosure.
Figure 2:
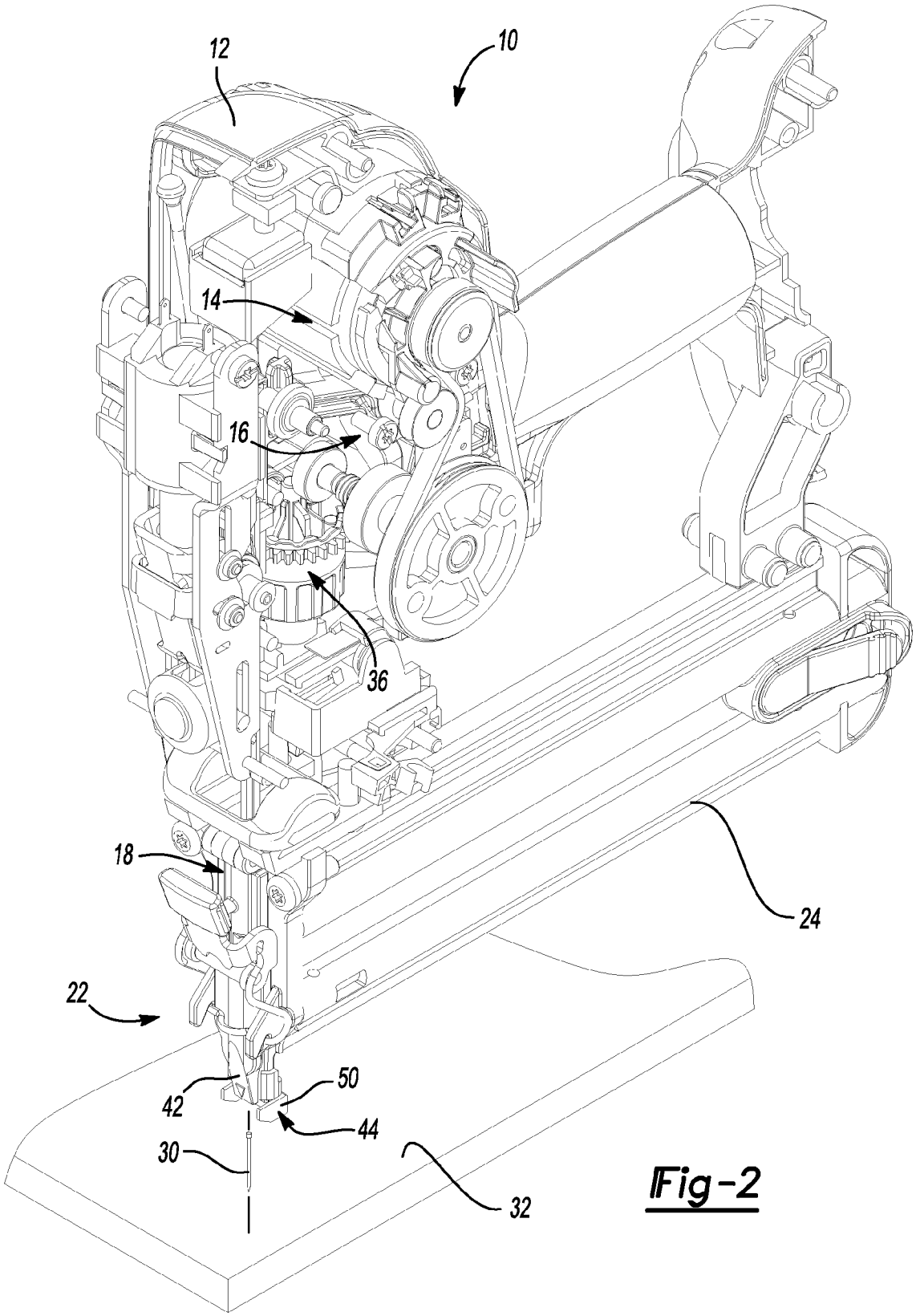
FIG. 2 is a perspective view of the fastening tool of FIG. 1 shown with portions of the housing removed and shown with an exemplary fastener and exemplary workpiece.

With initial reference to FIGS. 1 and 2, an exemplary fastening tool constructed in accordance with the present teachings is shown and generally identified at reference numeral 10. The fastening tool 10 can include an exterior housing 12, which can house a motor 14, a transmission 16 and a driver mechanism 18. The fastening tool 10 can also include a nose assembly 22, a fastener magazine 24 and a battery 26. The fastener magazine 24 can be coupled to the driver mechanism 18, while the battery 26 can be coupled to the exterior housing 12. The motor 14 can drive the transmission 16, which, in turn can actuate the driver mechanism 18. Actuation of the driver mechanism 18 can drive fasteners 30, which may be sequentially fed from the fastener magazine 24 into the nose assembly 22, into a work-piece 32. The fastening tool 10 can further include a depth adjusting assembly 36 (FIGS. 2, 3 and 6-14) and a lock-out mechanism 40 (FIGS. 5 and 15-20).

The fasteners 30 could be nails, staples, brads, clips or any suitable fastener that could be driven into a work-piece. It is appreciated that the magazine assembly 12 is merely exemplary and other configurations may be employed. Unless described otherwise herein, the fastening tool 10 may be constructed as described in co-pending, commonly assigned U.S. patent application Ser. No. 11/095,723 entitled "Method for Controlling a Power Driver" and U.S. patent application Ser. No. 11/095,727 entitled "Structural Backbone/Motor Mount for a Power Tool", the disclosures of which are hereby incorporated by reference as if fully disclosed in detail herein.

With additional reference to FIGS. 3 and 4, the nose assembly 22 will be described in greater detail. The nose assembly 22 may include a nosepiece 42 and a contact trip assembly 44. The contact trip assembly 44 can include a multi-component mechanical linkage that can connect the nosepiece 42 to a controller that can control the activation of the fastening tool 10. The contact trip assembly 44 can include a controller 46, a lower contact trip 50, an upper contact trip 52, a contact trip switch 54 and an adjustment rod 62.

The lower contact trip 50 can be slidably disposed along a nosepiece body 56. As will be described in greater detail, the position of the lower contact trip 50 may be adjustable so as to permit the tool operator to vary the depth at which the tool 10 sets the fasteners 30. The lower contact trip 50 can be integrally formed with or connect to a link member 60 (FIG. 3). The link member 60 can connect to the adjustment rod 62. The adjustment rod 62 can communicate axial motion between the lower contact trip 50 and the upper contact trip 52. The upper contact trip 52 can be operably coupled between the lower contact trip 50 and the controller 46 or contact trip switch 54. The upper contact trip 52 can move in response to axial movement of the lower contact trip 50 to activate a secondary trigger or the contact trip switch 54 associated with the controller 46.

The lower contact trip 50 is biased into an extended position by a spring 152, but can also be pushed against the work-piece 32 into a retracted position. In the retracted position, the upper contact trip 52 may rotate a linkage 64 (FIG. 4) whereby translation of the upper contact trip 52 in a direction upward, as viewed in FIG. 4, may urge clockwise rotation of the linkage 64 and therefore urge a conductive element 66 into engagement with the contact trip switch 54 to activate the contact trip switch 54. An opening 68 formed on the upper contact trip 52 can receive a cog 70 formed on the linkage 64. Once the contact trip switch 54 is activated, the controller 46 may receive a signal.

Figure 6:
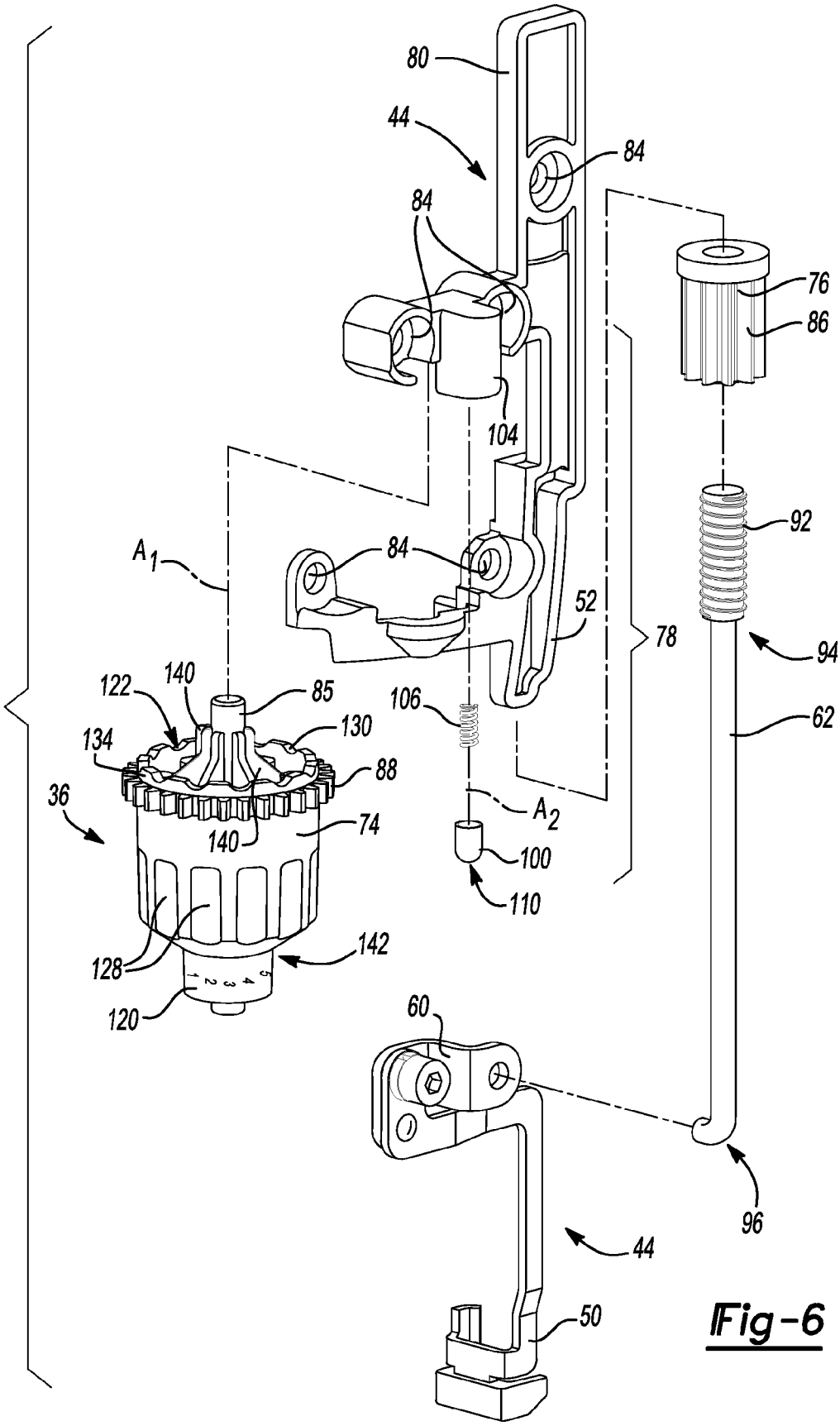
FIG. 6 is an exploded perspective view of the depth adjusting assembly and portions of a contact trip assembly.
Figure 7:
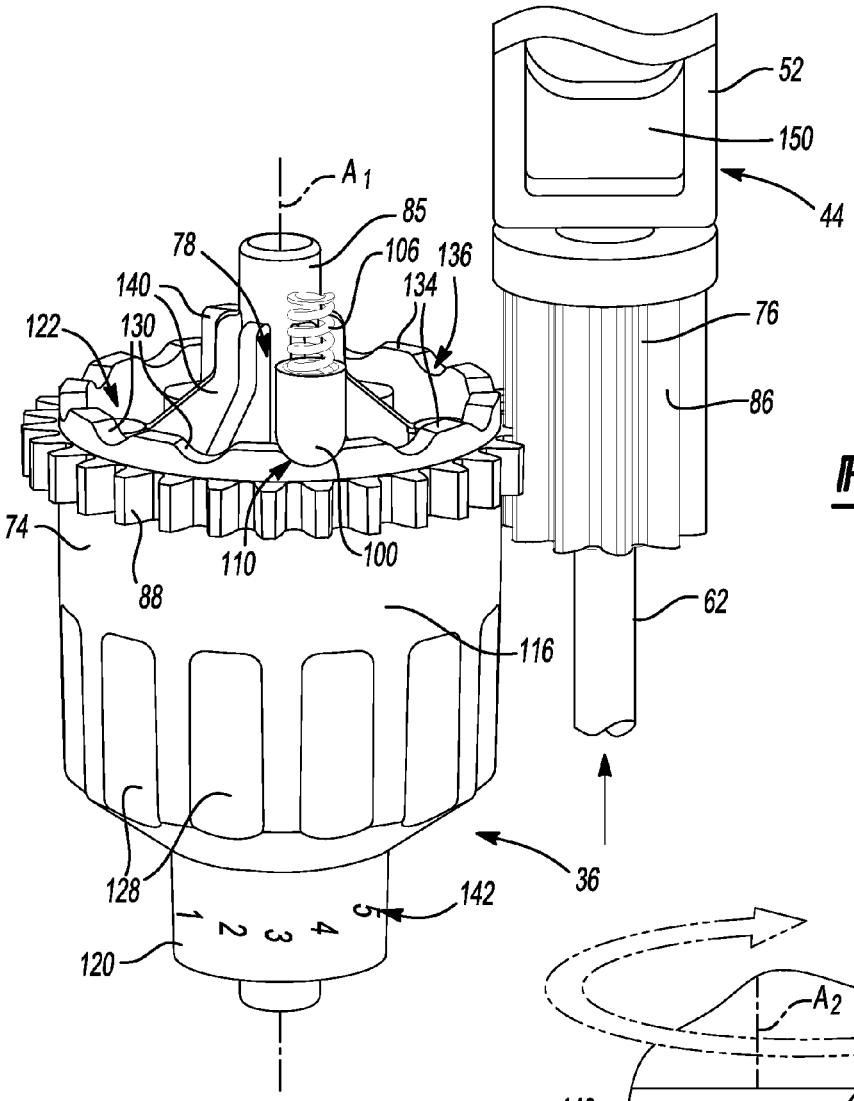
FIG. 7 is a side perspective view of the depth adjusting assembly showing a knob rotatably engaged with a pinion.
Figure 8:
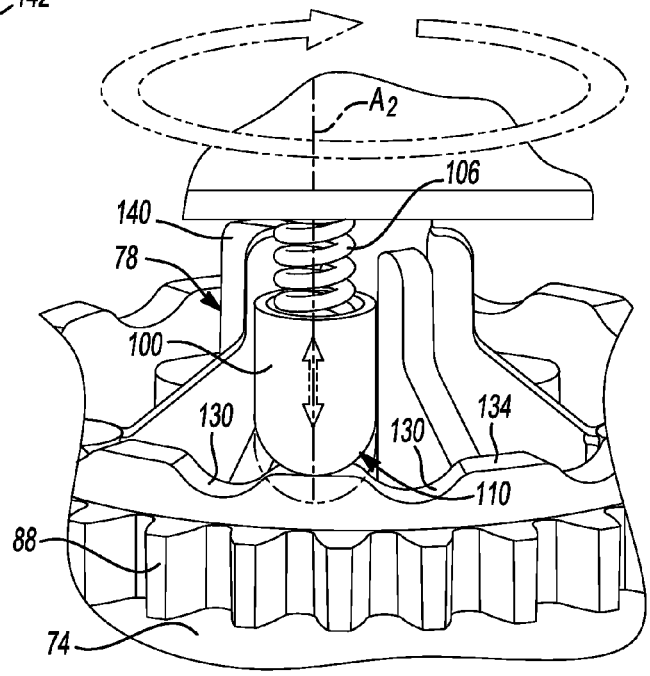
FIG. 8 is a side perspective view an indexing member slidably engaged with locating formations formed on the knob.

With reference now to FIGS. 6-8, the depth adjusting assembly 36 will be described in greater detail. The depth adjusting assembly 36 may be operably disposed intermediate the lower contact trip 50 and the upper contact trip 52. In general, the depth adjusting assembly 36 can be employed to control the depth at which a fastener is driven into a workpiece (i.e., to a depth that could be raised above, flush with or below the surface of the workpiece 32). In this way, the depth adjusting assembly 36 cooperates with the upper contact trip assembly 44 so as to permit the tool operator to vary the depth at which the tool 10 sets the fasteners 30.

Figure 3:
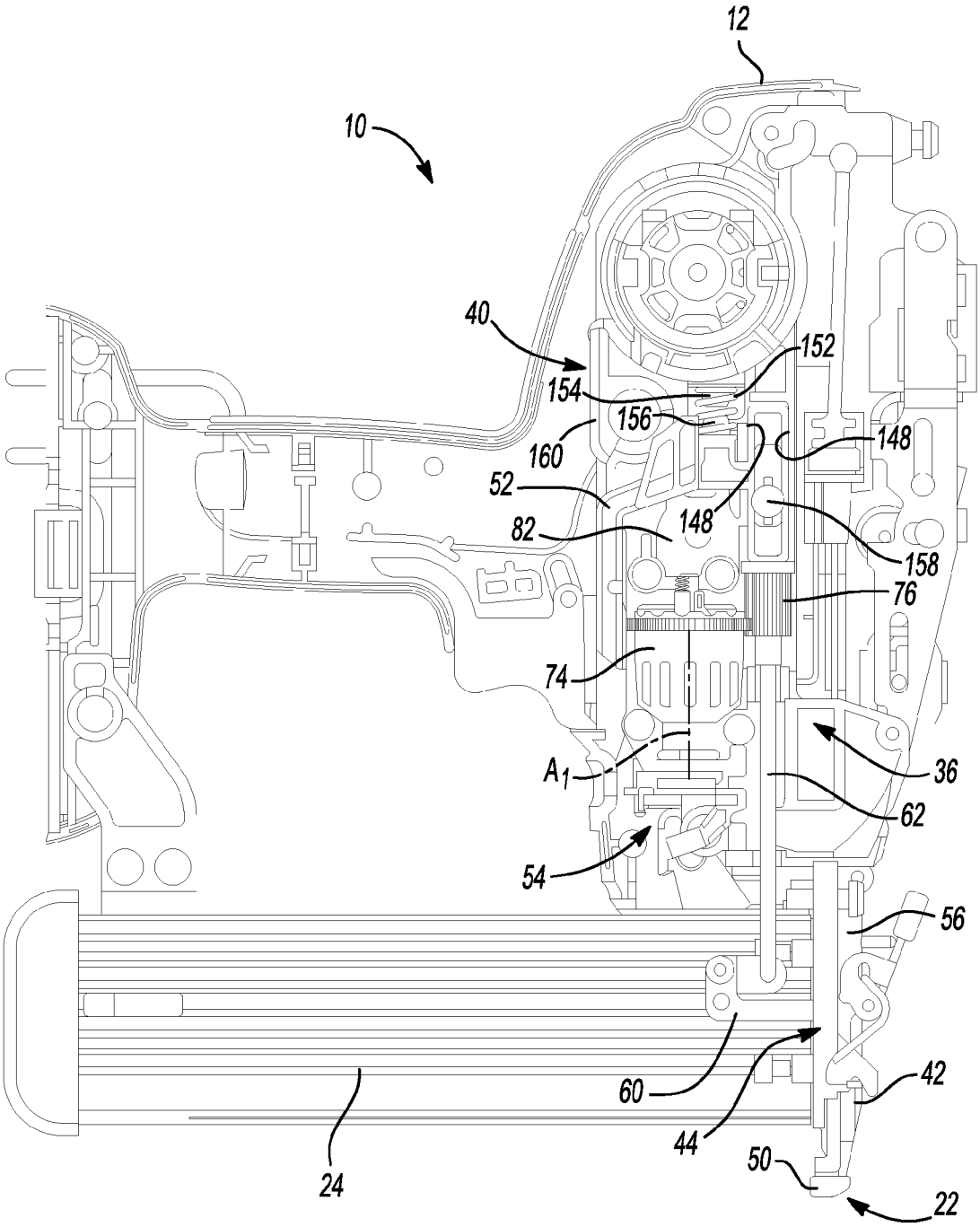
FIG. 3 is a side view of a portion of the fastening tool of FIG. 1 illustrating portions of a depth adjusting assembly.
Figure 4:
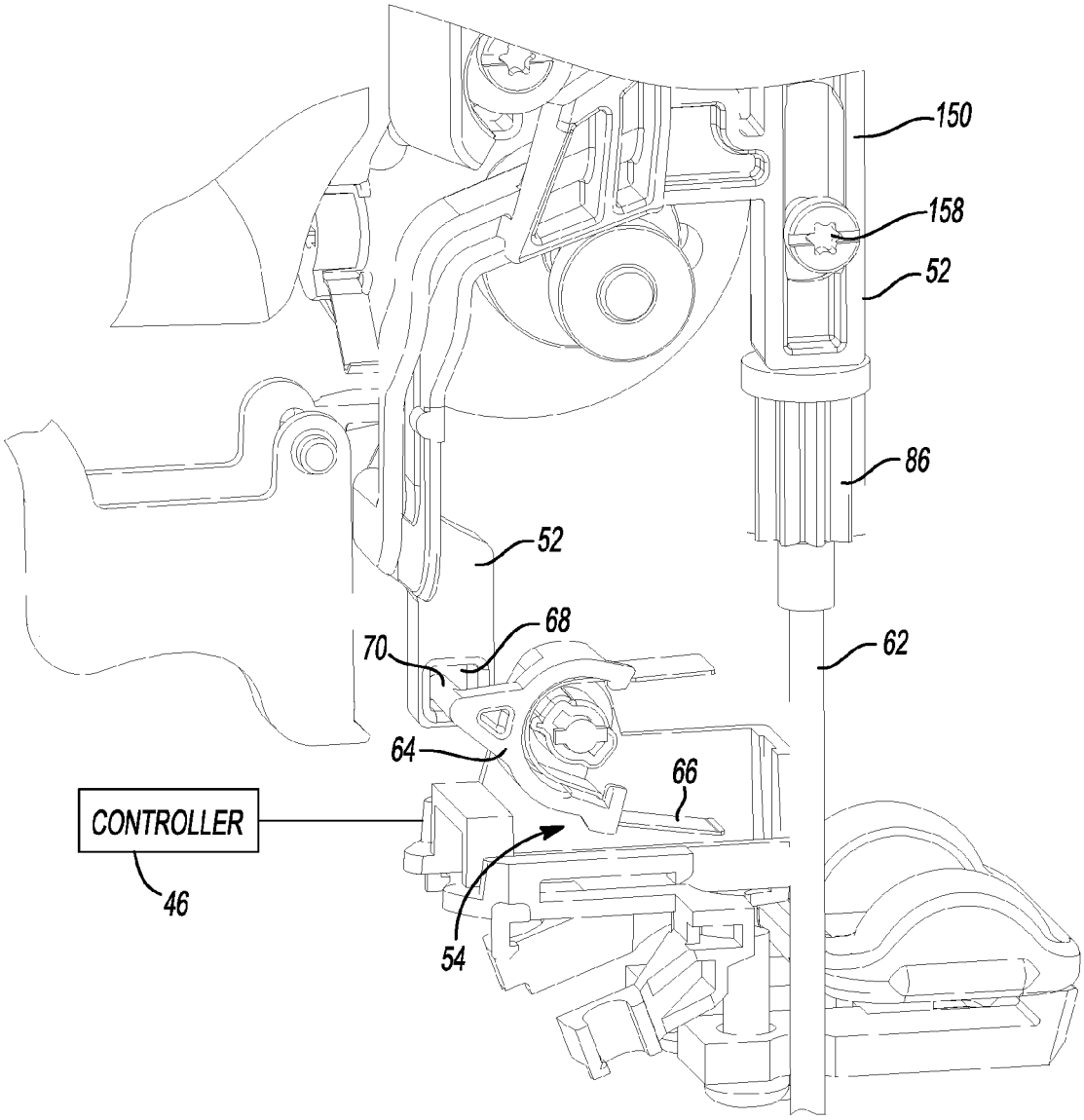
FIG. 4 is a side perspective view of a portion of the fastening tool of FIG. 1 illustrating a contact trip switch operably connected to an upper contact trip.

With additional reference to FIG. 3, the depth adjusting assembly 36 may include a knob 74, a pinion gear 76, an indexing assembly 78 and a depth adjustment cage 80. The cage 80 can include mounting hubs 84 for accepting fasteners (not specifically shown) operable to secure the cage 80 to a backbone 82 (FIG. 3) of the tool 10. As a result, the cage 80 can be fixed relative to the backbone 82 (FIG. 3). The knob 74 may be rotatably mounted about a shaft 85 defining an axis $A_1$ (FIG. 3) on the backbone 82 (FIG. 3) secured within the tool 10. Rotation of the knob 74 can result in translation of the lower contact trip 50 along the nosepiece body 56.

The pinion gear 76 may generally define a series of pinion teeth 86 formed around an outer diameter and meshed for rotation with a complementary series of knob teeth 88 formed around an outer diameter of the knob 74. The pinion 76 may also define pinion threads 90 (FIG. 11) formed within an inner diameter. The pinion threads 90 may be threadably engaged with rod threads 92 (FIG. 6) formed on an outer diameter of a proximal end 94 of the adjustment rod 62. In one example, the pinion threads 90 and rod threads 92 may define a high pitch such as a double lead thread. A distal end 96 of the adjustment rod 62 may be connected to the link member 60 and ultimately the lower contact trip 50. The interaction of the respective pinion threads 90 and rod threads 92 allow the adjustment rod 62 to translate along its axis.

The indexing assembly 78 may generally include a detent or indexing member 100 fixed for translation along an axis $A_2$. The indexing member 100 may be at least partially retained by a barrel 104 (FIG. 6) formed on the depth adjust cage 80 and biased in a direction toward engagement with the knob 74 by a biasing member 106. The indexing member 100 may define a spherical or dome-like engagement surface 110 on a distal end.

Figure 5:
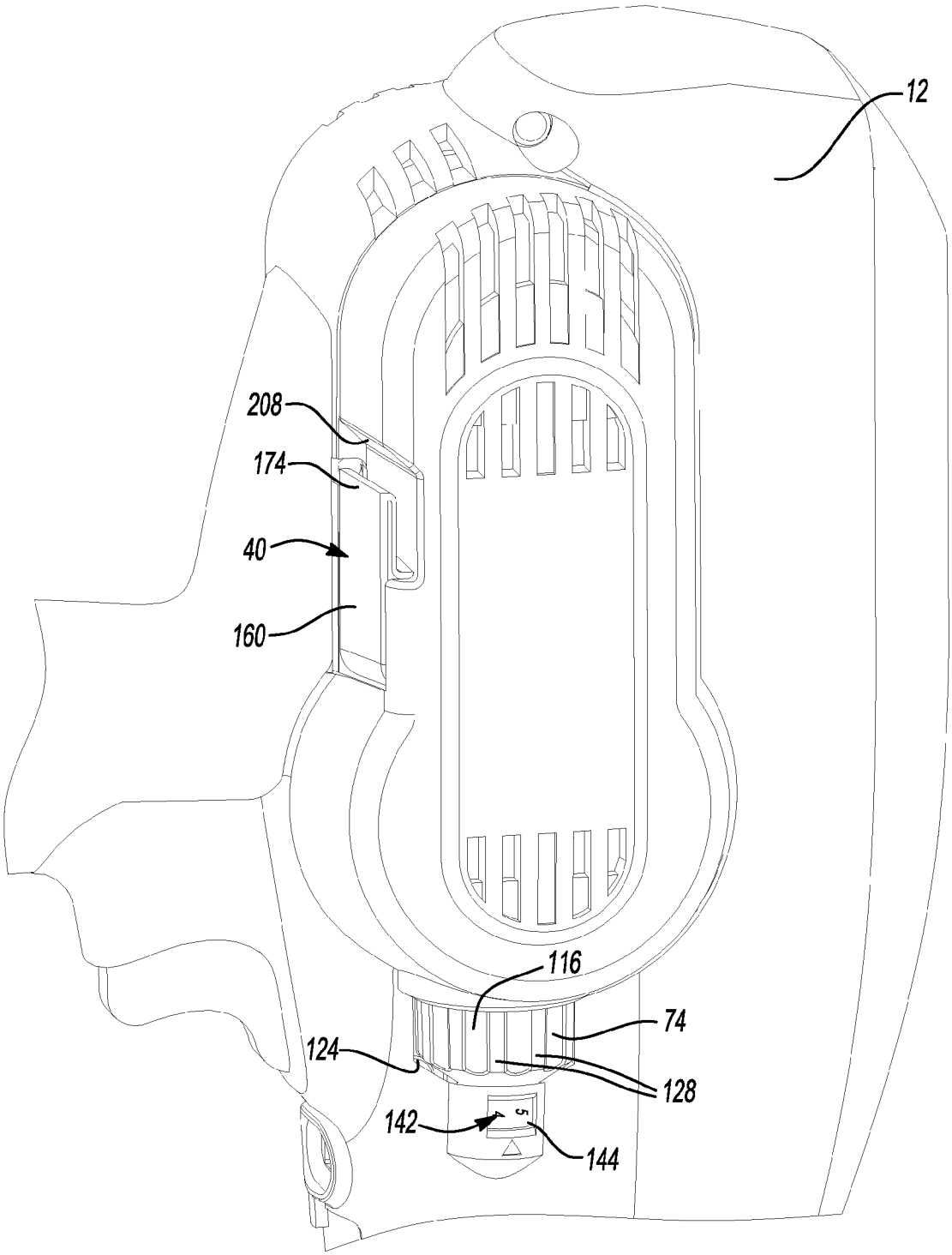
FIG. 5 is a detailed side perspective view of the fastening tool of FIG. 1 illustrating portions of a lock-off mechanism.

The knob 74 will now be described in greater detail. The knob 74 may generally define a central body 116, a distal section 120 and an end face 122. As best illustrated in FIG. 5, the knob 74 may be visible through an aperture 124 formed in the housing 12. A series of grooves 128 may be defined around an outer surface of the central body 116 of the knob 74 to form a grip that permits a user to rotate the knob 74. Returning to FIGS. 3 and 6-8, the knob 74 may define a series of locating formations 130 formed around the end face 122. The locating formations 130 may be separated by lands 134 formed between each adjacent locating formation 130. The locating formations 130 may be configured to cooperate with the indexing member 100 to selectively locate the knob 74 in a predetermined position. In one example, the locating formations 130 may define radial pockets 136 complementary to structure of the dome-like engagement surface 110 of the indexing member 100 such that the indexing member 100 may securably nest within a given locating formation 130. In this way, when the indexing member 100 is nested into engagement with a locating formation 130 on the end face 122 of the knob 74, a user must apply sufficient rotational force onto the knob 74 to overcome the force of the biasing member 106 and thus encourage the indexing member 100 to ramp out of the locating formation 130. Once the indexing member 100 has sufficiently ramped out of a locating formation 130, the indexing member 100 can slidably communicate across an adjacent land 134 until being urged (by the biasing member 106) into engagement with an adjacent locating formation 130. A rib 140 may be formed on the knob 74 and adapted to engage the backbone 82 at a rotational limit of the knob 74. As best illustrated in FIGS. 7 and 8, the indexing member 100 may be operable to engage the knob 74 in an axial direction relative to the rotational axis $A_1$ of the knob 74. Explained differently, the axis of translation $A_2$ of the indexing member 100 can be substantially parallel to the axis of translation $A_1$ of the knob 74.

The knob 74 may further define indicia 142 located around an outer surface of the distal section 120. The indicia 142 may comprise characters such as numbers that correspond to a selected depth setting. A window 144 (FIG. 1) can be formed on the housing 12 that permits a user to view the selected indicia 142. As can be appreciated, as the knob 74 is rotated to translate the lower contact trip 50, the indicia 142 viewed through the window 144 may also change. In this way, a user may rotate the knob 74 until a predetermined number, or desired setting is reached.

The backbone 82 may define a track 148 (FIGS. 3 and 4) that slidably captures a frame portion 150 defined on the upper contact trip 52. 150 extending from the backbone 82. A spring 152 can be disposed between a post 154 formed on the backbone 82 and a post 156 formed on the upper contact trip 52. The spring 152 can bias the upper contact trip 52 into engagement with a proximal end of the pinion 76 to thereby drive the pinion 76 and the lower contact trip 52 downwardly. A fastener 158 is shown extending through a passage in the frame portion 150 that secures the backbone 82 of the tool 10.

Figure 11:
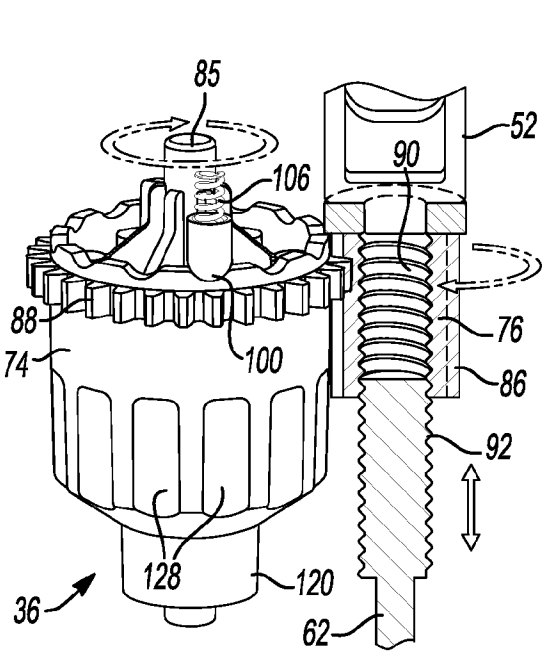
FIGS. 9-11 are action sequence views illustrating linear translation of an adjustment rod via rotational motion of the knob.
Figure 10:
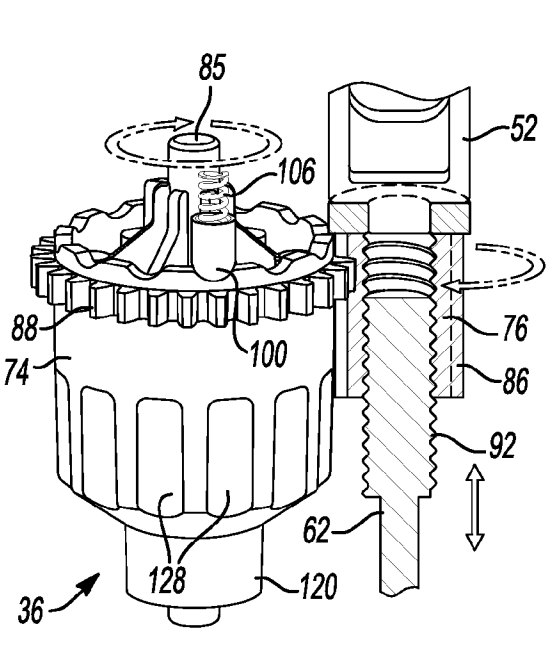
Figure 9:
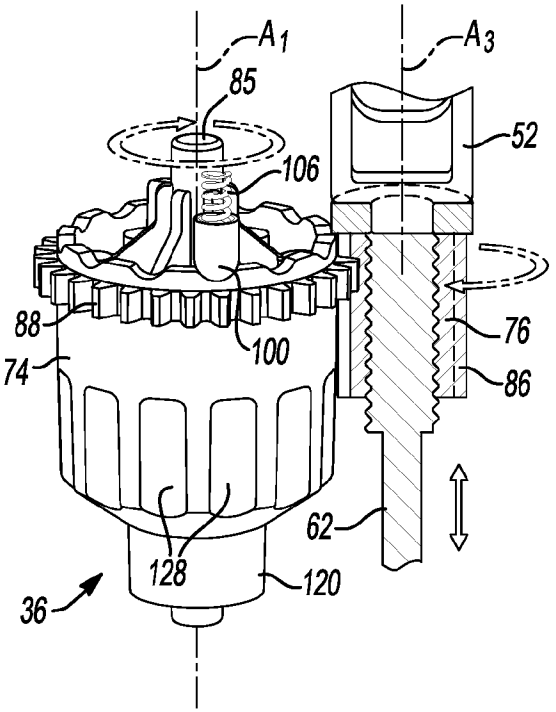
Figures 12, 13, 14:
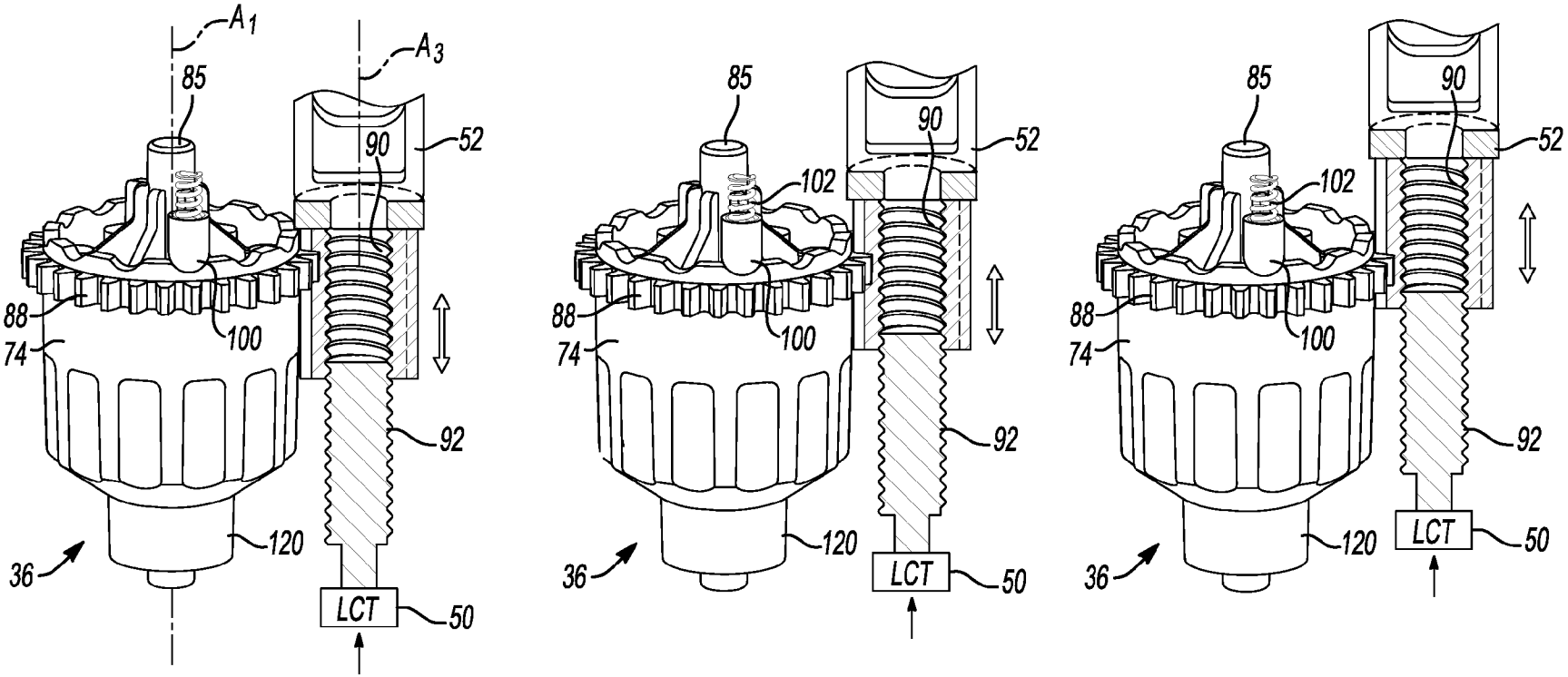
FIGS. 12-14 are action sequence views illustrating collective translation of the adjustment rod and pinion through teeth formed around the knob during depression of the contact trip assembly, the knob remaining in a static position.
Figure 15:
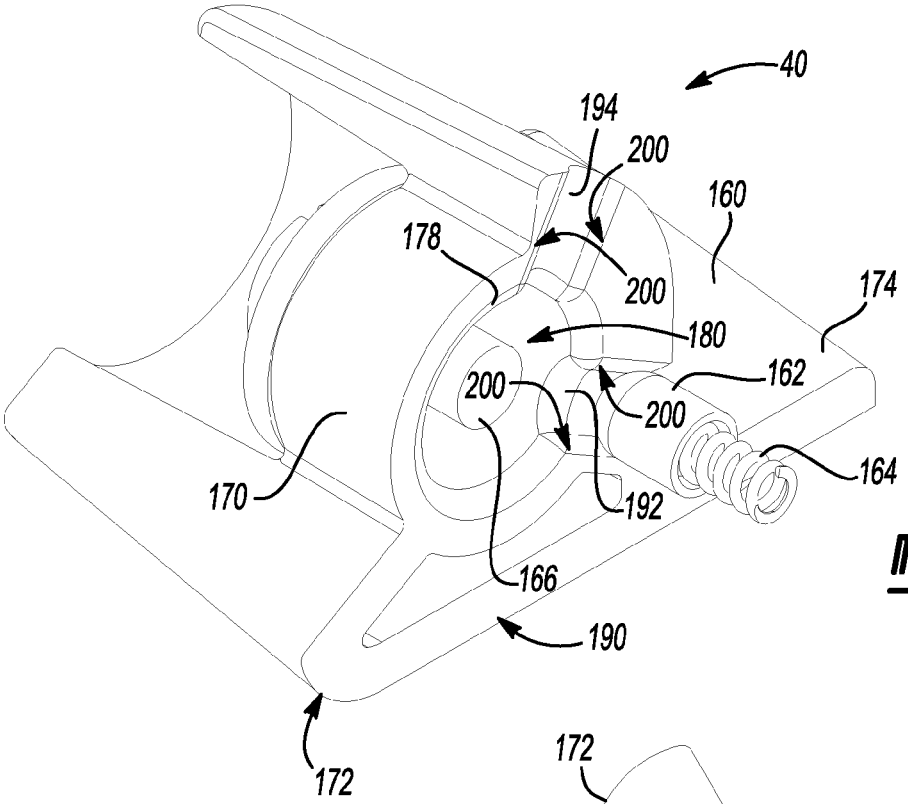
FIG. 15 is a rear perspective view of a portion of the fastening tool of FIG. 1 illustrating a lock-out mechanism including a lock-off paddle shown with a spring loaded indexing bolt.
Figure 16:
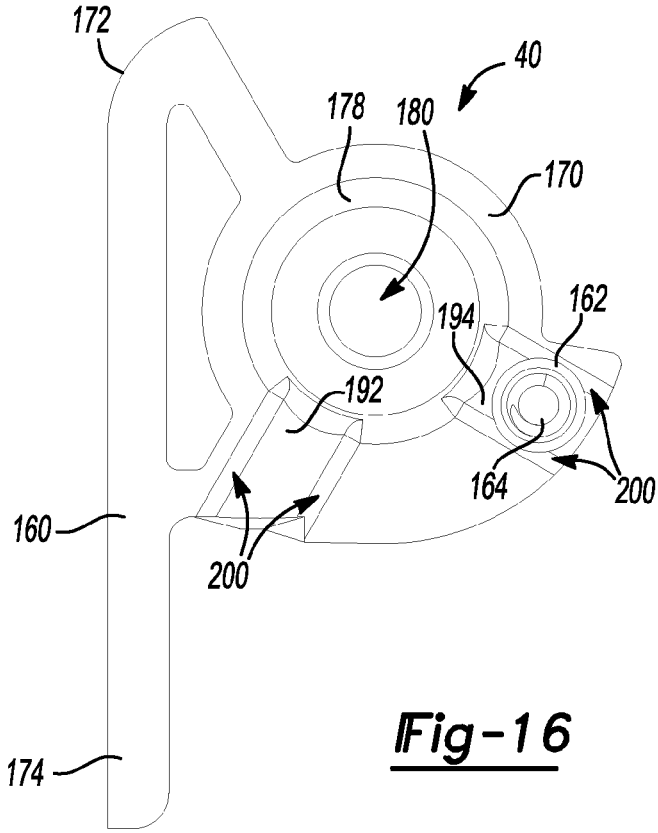
FIG. 16 is a rear plan view of the lock-off paddle and indexing bolt.

With reference to FIGS. 9-11, operation of the depth adjusting assembly 36 will now be described. At the outset, a user may rotate the knob 74 to a desired location. In one example, the knob 74 may be rotated until a predetermined setting or number is revealed through the aperture 124. Rotation of the knob 74 can cause the knob teeth 88 to impart rotational motion onto the pinion teeth 86. It is important to recognize that in this particular example, the meshed interaction between the knob 74 and the pinion 76 may be configured to simply force the pinion 76 to rotate about a pinion axis $A_3$ and not translate about the pinion axis $A_3$. The rotation of the pinion 76, in turn, causes the adjustment rod 62 to translate axially by way of the threaded engagement between the inner threads 90 on the pinion 76 and the outer threads 92 on the adjustment rod 62. In the particular example shown, the adjustment rod 62 can be fixed to the lower contact trip 50. As a result, rotation of the knob 74 changes the effective length of the contact trip assembly 44. By changing the effective length of the contact trip assembly 44 (FIG. 2), the user can control the depth that the fastening tool drives a fastener 30 into a work-piece 32.

With particular reference now to FIGS. 3 and 12-14, advancement of the lower contact trip 50 resulting from engagement with a workpiece will be described. Once the desired depth of penetration has been set with the knob 74, the user may push the lower contact trip 50 against a workpiece to move the lower contact trip 50 into the retracted position. This motion is shown sequentially in FIGS. 12-14. Consequently, translation of the contact trip 50 along the nosepiece body 56 (in a direction upward as viewed from FIG. 3) can cause the adjustment rod 62 and the pinion 76 to also move upward. The pinion teeth 86 may be free to slide axially along the knob teeth 88 without imparting rotational motion onto the knob 74. The pinion 76 can urge the upper contact trip 52 upward against the bias of the spring 152. The frame portion 150 (FIG. 4) slides in the track 148 of the backbone 82. As explained earlier, the upper contact trip 52 may be coupled to the linkage 64 whereby translation of the upper contact trip 52 in a direction upward urges clockwise rotation of the linkage 64 and therefore urging of the conductive element 66 into engagement with the contact trip switch 54 to activate the contact trip switch 54.

Figure 17:
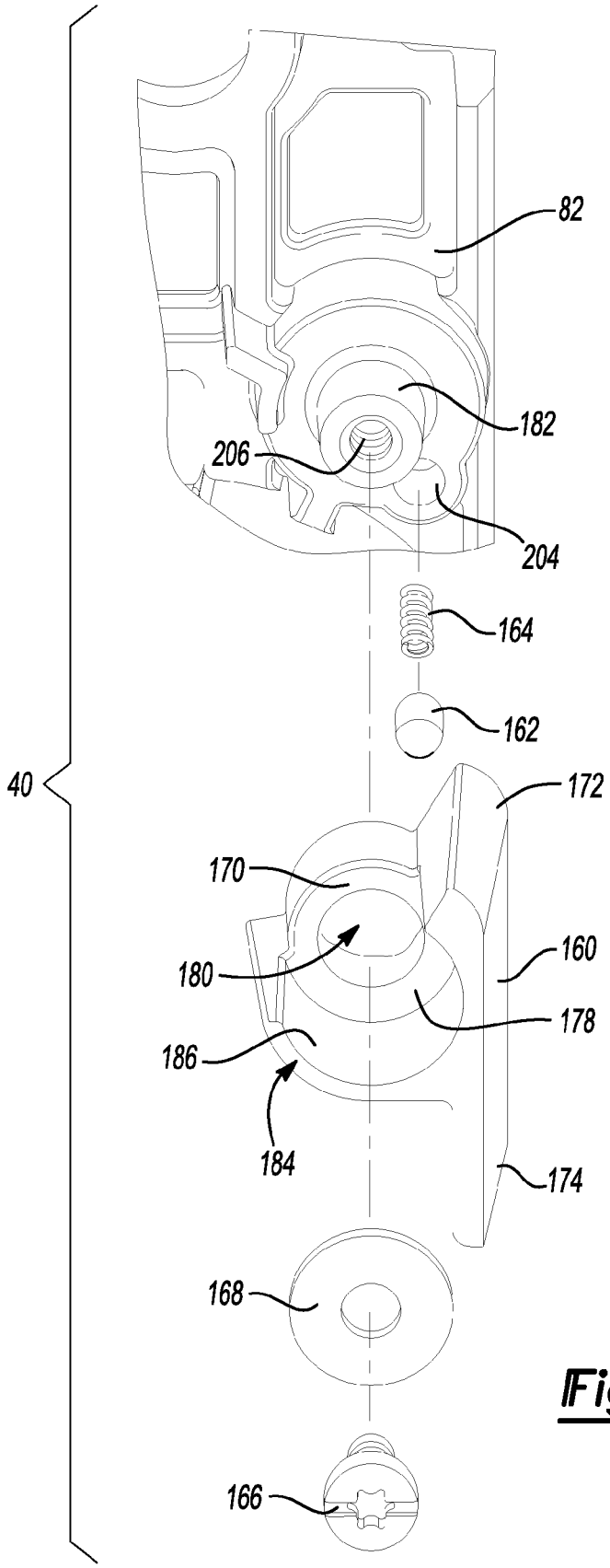
FIG. 17 is an exploded perspective view of the lock-off mechanism.
Figure 19:
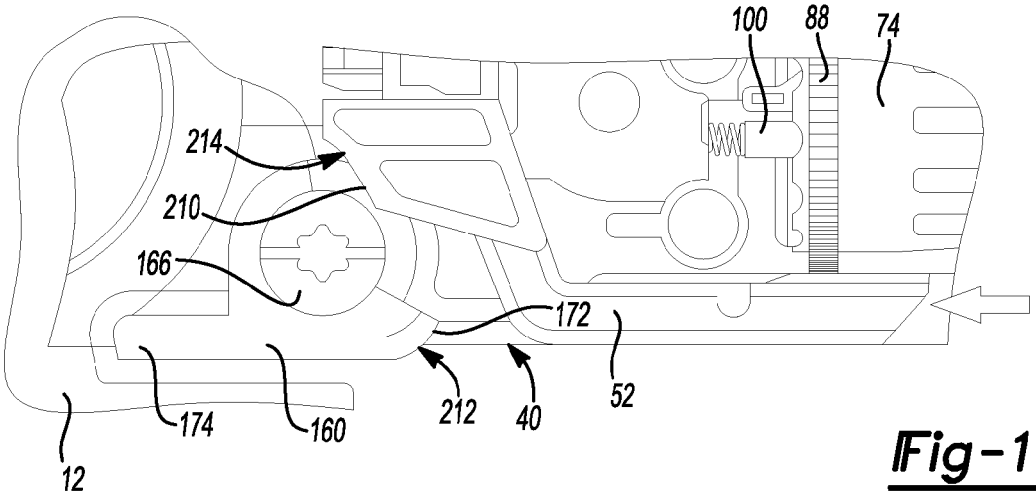
FIG. 19 is a side view of the lock-off mechanism shown in the disengaged position with the upper contact trip actuated.
Figure 20:
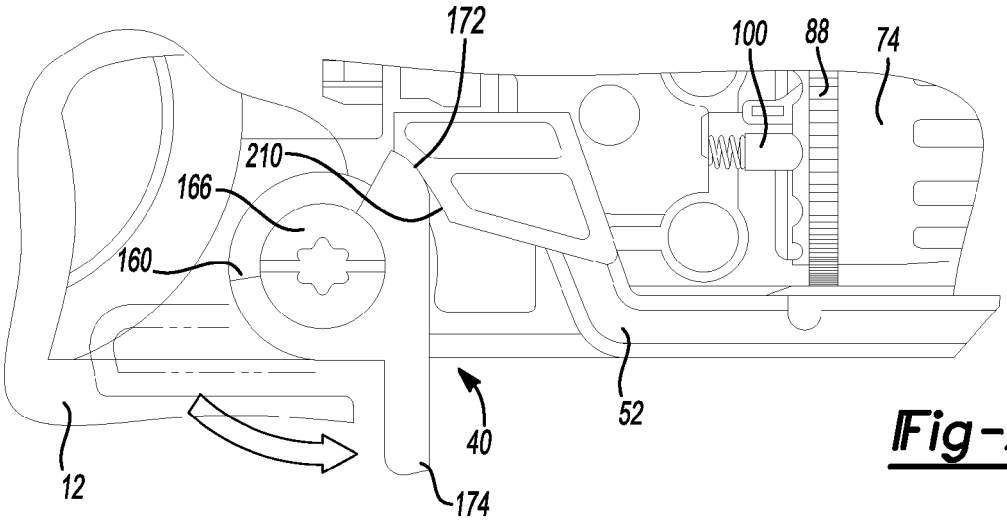
FIG. 20 is a side view of the lock-off mechanism in an engaged position wherein the lock-off paddle engages the upper contact trip and precludes actuation of the upper contact trip.

Turning now to FIGS. 5 and 17, the lock-out mechanism 40 will be described in greater detail. The lock-out mechanism 40 can include a paddle 160, an indexing bolt 162, a biasing member 164, a fastener 166 and a washer 168. In general, the paddle 160 is movable between a disengaged position (FIGS. 3, 18 and 19) and an engaged position (FIG. 20). The paddle 160 may generally include a body 170 having an elbow 172, a lever arm 174 and a mounting portion 178. The mounting portion 178 can define a passage 180 for rotatably mounting on a post 182 formed on the backbone 82. A front side 184 of the paddle 160 may define an annular wall 186 adapted to locate the washer 168 in an installed position. With additional reference to FIGS. 15 and 16, a rear side 190 of the paddle 160 may define at least a first and second detent 192 and 194, respectively that may be formed with ramped walls 200. As can be appreciated, the detents 192 and 194 are configured to accept the indexing bolt 162 and thereby locate the paddle 160 at the disengaged position (FIGS. 18 and 19), and the engaged position (FIG. 20). In the example provided, the first detent 192 may correspond to the disengaged position and the second detent 194 may correspond to the engaged position.

A blind bore 204 (FIG. 17) may be formed in the backbone 82 for accepting the biasing member 164 and at least a portion of the indexing bolt 162. A threaded bore 206 may be formed in the post 182 for accepting the bolt 166. The post 182 may define an outer diameter that can be received into an inner diameter of the passage 180 formed in the paddle 160. As such, it will be appreciated that the paddle 160 can be rotatably mounted on the post 182.

Figure 18:
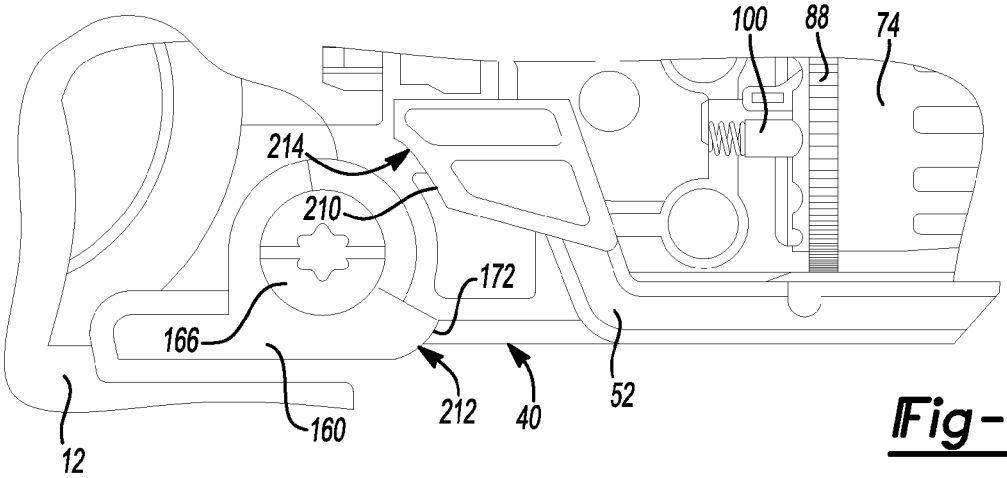
FIG. 18 is a side view of the lock-off mechanism shown in a disengaged position.

With specific reference now to FIGS. 18-20, an exemplary method of using the lock-out mechanism 40 will be described. As mentioned above, the paddle 160 is shown in the disengaged position in FIGS. 18 and 19. In the disengaged position, the lever arm 174 may extend through the housing 12 and occupy a position generally lateral to the housing 12 of the tool 10 (see also FIG. 3). In the disengaged position, the elbow 172 can be generally offset from the upper contact trip 52 such that the upper contact trip 52 is free to move from a position shown in FIG. 18 leftward to a position shown in FIG. 19. As explained above, the slidable translation of the upper contact trip 52 can occur during actuation of the contact trip assembly 44 (FIG. 3) during use. More specifically, leftward movement of the upper contact trip 52 is necessary to activate the contact trip switch 54. Turning now to FIG. 20, the paddle 160 is shown rotated counter-clockwise (relative to FIGS. 18 and 19) in the engaged position. As shown in FIG. 5, a user can access the lever arm 174 through a relief 208 formed in the housing 12. In the engaged position, the elbow 172 can be disposed in-line with a rear heel 210 formed on the upper contact trip 52. In the engaged position shown in FIG. 20, the upper contact trip 52 can be precluded from movement leftward as the elbow 172 can contact the rear heel 210 and inhibit further leftward movement of the upper contact trip 52. It will be appreciated that such contact precludes the contact trip assembly 44 from being positioned in the retracted position so that the contact trip switch 54 cannot be actuated. In one example, the elbow 172 may define an outboard radial surface 212 adapted to slidably traverse about an inboard radial surface 214 of the upper contact trip 52. It is appreciated that other arrangements may be used that are operable to preclude movement of the upper contact trip 52.

While the invention has been described in the specification and illustrated in the drawings with reference to various embodiments, it will be understood by those skilled in the art that various changes may be made and equivalents may be substituted for elements thereof without departing from the scope of the invention as defined in the claims. Furthermore, the mixing and matching of features, elements and/or functions between various embodiments is expressly contemplated herein so that one of ordinary skill in the art would appreciate from this disclosure that features, elements and/or functions of one embodiment may be incorporated into another embodiment as appropriate, unless described otherwise above. Moreover, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. A fastening tool comprising:

a housing;

a motor assembly in the housing, the motor assembly including an output member and a motor for translating the output member;

a knob rotatably mounted in the housing around a first axis;

an adjustment rod operatively coupled for movement with the knob;

a pinion defining an outer diameter meshed for rotation with the knob and an inner diameter threaded for rotation with the adjustment rod, the pinion transferring rotational movement of the knob into linear translation of the adjustment rod;

a lower contact trip coupled to the adjustment rod; and wherein rotation of the knob causes the contact trip to translate toward and away from the housing to define a desired penetration depth for the fastener.

2. The fastening tool of claim 1 wherein the indexing member imparts a retaining force onto the knob thereby inhibiting rotation of the knob when the indexing member is engaged with one of the locating formations.

3. The fastening tool of claim 2 wherein the indexing member defines a dome-like engagement surface adapted to nest within one of the plurality of locating formations.

4. The fastening tool of claim 1 wherein the pinion defines pinion teeth formed along a length thereof, wherein depression of the lower contact trip causes the pinion to move along a pinion axis and the pinion teeth to slide along, and remain meshed for rotation with, complementary knob teeth formed along the knob without imparting rotation onto the knob.

5. The fastening tool of claim 1, further comprising a series of indicia arranged around a radial surface of the knob, wherein each of the series of indicia corresponds to a selected penetration depth, wherein the selected penetration depth coincides with the indexing member being engaged with one of the locating formations.

6. The fastening tool of claim 1 wherein the knob defines a rib formed thereon, the rib adapted to engage structure fixed to the housing and inhibit further rotation of the knob thereby defining a rotational limit of the knob.

7. The fastening tool of claim 1 wherein the knob at least partially extends through an aperture formed on the housing.

8. The fastening tool of claim 1 wherein the knob defines a plurality of locating formations and further comprising an indexing member movable along a second axis parallel to the first axis, the indexing member selectively biased into engagement with one of the locating formations upon rotation of the knob to resist rotation of the knob relative to the housing.

9. A fastening tool comprising:

a housing having an opening that defines a window;

a motor assembly in the housing, the motor assembly including an output member and a motor for translating the output member;

a knob rotatably mounted in the housing around a first axis and defining a plurality of locating formations arranged thereon, the knob having a series of indicia arranged thereon that correspond to a respective series of penetration depths;

an adjustment rod operatively coupled for movement with the knob;

a lower contact trip coupled to the adjustment rod; and an indexing member selectively engaged with one of the locating formations upon rotation of the knob to resist rotation of the knob relative to the housing;

an adjustment element coupled for rotation with the rod and having a pinion defining an outer diameter meshed for rotation with the knob and an inner diameter threaded for rotation with the adjustment rod, the pinion transferring rotational movement of the knob into linear translation of the adjustment rod;

wherein rotation of the knob causes the contact trip to translate toward and away from the housing to define a desired penetration depth for the fastener, and wherein the desired penetration depth coincides with the indexing member being engaged with one of the locating formations and a corresponding indicium of the series of indicia aligning with the window.

10. The fastening tool of claim 9 wherein the indexing member imparts a retaining force onto the knob thereby inhibiting rotation of the knob when the indexing member is engaged with one of the locating formations.

11. The fastening tool of claim 10 wherein the indexing member defines a dome-like engagement surface adapted to nest within one of the plurality of locating formations.

12. The fastening tool of claim 9 wherein the pinion defines pinion teeth formed along a length thereof, wherein depression of the lower contact trip causes the pinion to move along a pinion axis and the pinion teeth to slide along, and remain meshed for rotation with, complementary knob teeth formed along the knob without imparting rotation onto the knob.

13. The fastening tool of claim 9 wherein the series of indicia are arranged around a radial surface of the knob.

14. The fastening tool of claim 9 wherein the knob defines a rib formed thereon, the rib adapted to engage structure fixed to the housing and inhibit further rotation of the knob thereby defining a rotational limit of the knob.

15. The fastening tool of claim 9 wherein the knob at least partially extends through an aperture formed on the housing.

16. A fastening tool comprising:

a housing;

a motor assembly in the housing, the motor assembly including an output member and a motor for translating the output member;

a knob rotatably mounted in the housing around a first axis;

an adjustment element that translates the rod upon rotation of the knob;

an adjustment rod operatively coupled for movement with the knob and having a pinion defining an outer diameter meshed for rotation with the knob and an inner diameter threaded for rotation with the adjustment rod, the pinion transferring rotational movement of the knob into linear translation of the adjustment rod;

a lower contact trip coupled to the adjustment rod;

wherein rotation of the knob causes the contact trip to translate toward and away from the housing to define a desired penetration depth for the fastener; and wherein depression of the lower contact trip causes translation of the adjustment element without imparting rotation onto the knob.

17. The fastening tool of claim 16 wherein the knob defines a plurality of locating formations and further comprising an indexing member movable along a second axis parallel to the first axis, the indexing member selectively biased into engagement with one of the locating formations upon rotation of the knob to resist rotation of the knob relative to the housing.

* * * * *